US011927006B2

(12) United States Patent
Huang et al.

(10) Patent No.: US 11,927,006 B2
(45) Date of Patent: Mar. 12, 2024

(54) PUSHING FORCE CONVERTING MECHANISM AND CONCEALED WATER TANK

(71) Applicant: Kohler (China) Investment Co., Ltd., Shanghai (CN)

(72) Inventors: Congxian Huang, Shanghai (CN); Youpeng Chen, Shanghai (CN)

(73) Assignee: Kohler (China) Investment Co., Ltd., Shanghai (CN)

( * ) Notice: Subject to any disclaimer, the term of this patent is extended or adjusted under 35 U.S.C. 154(b) by 0 days.

(21) Appl. No.: 17/726,150

(22) Filed: Apr. 21, 2022

(65) Prior Publication Data

US 2022/0381019 A1 Dec. 1, 2022

(30) Foreign Application Priority Data

May 25, 2021 (CN) ..... 202121138185.4

(51) Int. Cl.
*E03D 5/02* (2006.01)

(52) U.S. Cl.
CPC ..... *E03D 5/024* (2013.01); *E03D 5/028* (2013.01)

(58) Field of Classification Search
CPC ..... E03D 5/024; E03D 5/028
USPC ..... 4/300, 407, 410
See application file for complete search history.

(56) References Cited

FOREIGN PATENT DOCUMENTS

| | | | | |
|---|---|---|---|---|
| CN | 201809839 U * | 4/2011 | ..... | E03D 5/024 |
| CN | 207073174 U * | 3/2018 | | |
| EP | 1491690 A1 | 12/2004 | | |
| EP | 1498553 A1 | 1/2005 | | |
| IT | UA20163286 A1 | 10/2017 | | |
| WO | WO-2018041399 A1 * | 3/2018 | ..... | E03D 5/028 |

OTHER PUBLICATIONS

Extended European Search Report from European Patent Application No. 22172629.2, dated Oct. 19, 2022, 9 pages.

* cited by examiner

*Primary Examiner* — Tuan N Nguyen
(74) *Attorney, Agent, or Firm* — Lempia Summerfield Katz, LLC

(57) ABSTRACT

The present disclosure provides a pushing force converting device including a cylinder barrel. The cylinder barrel includes an air cavity; a mounting cavity; and an air cavity vent in communication with the air cavity. The pushing force converting device also includes a piston configured to slide back and forth in the cylinder barrel and slidably disposed in the mounting cavity; a transmission bar connected with the piston and configured to drive the piston to move toward the air cavity; a restoring member disposed in the cylinder barrel and configured to drive the piston or the transmission bar to be restored to a respective initial position; and a sealing ring disposed on the piston and configured to seal the air cavity. The pushing force converting device disclosed by the present disclosure can convert mechanical pushing force into air pressure pushing force.

19 Claims, 8 Drawing Sheets

PUSHING FORCE CONVERTING MECHANISM AND CONCEALED WATER TANK

CROSS REFERENCE TO RELATED APPLICATION

This application claims the benefit of priority to Chinese Patent Application No. 202121138185.4 filed in the Chinese Intellectual Property Office on May 25, 2021, which is hereby incorporated by reference in its entirety.

FIELD

The present disclosure relates to the technical field of sanity devices and, in particular, to a pushing force converting mechanism and a concealed water tank.

BACKGROUND

The body of a concealed water tank is generally mounted in a wall, and a flushing panel is mounted on the surface of the wall. The flushing panel controls, through a driving device, a discharge valve in the water tank to enable discharging of water. The flushing panel has a button for controlling the driving device.

Discharge valves include connecting rod discharge valves and pneumatic discharge valves. If a connecting rod discharge valve is adopted, a corresponding mechanical driving device is needed. If a pneumatic discharge valve is adopted, a corresponding pneumatic driving device is needed.

The overflow pipe of a connecting rod discharge valve is provided with a connecting rod. The mechanical driving device comprises a transmission bar assembly. The flushing panel has a panel button that can drive the transmission bar to move. When the panel button is pressed down, the transmission bar assembly is actuated and acts on the connecting rod to drive the overflow pipe to rise up, and the connecting rod discharge valve is opened to discharge water.

A pneumatic discharge valve has a discharge valve air bag that can drive the overflow pipe to rise up. The pneumatic driving device comprises a driving device air bag. The flushing panel has a panel button that can squeeze the driving device air bag. The driving device air bag is connected to the discharge valve air bag through an air pipe. When the panel button is pressed down, the driving device air bag is squeezed, and the air within the driving device air bag will enter the discharge valve air bag. The discharge valve air bag is inflated, and the volume thereof increases, which drives the overflow pipe to rise up. The pneumatic discharge valve is opened to discharge water.

With respect to the structure and the operating principle of a pneumatic discharge valve, reference can be made to the Chinese utility model publication No. CN212248552U. With respect to the structure and the operating principle of a pneumatic driving device, reference can be made to the Chinese utility model publication No. CN206916866U.

In the prior art, the air bag of a pneumatic driving device has a flexible structure, which needs an exclusive guide mechanism, and thus it has a complex structure. In addition, the air bag restores to its initial state slowly, and thus its transmission performance needs to be improved.

SUMMARY

The objective of the present disclosure is to provide a pushing force converting mechanism and a concealed water tank, which can convert mechanical pushing force into air pressure pushing force and has good structure stability and good transmission effect.

The technical solutions of the present disclosure provide a pushing force converting mechanism comprising at least one pushing force converting device; the pushing force converting device comprises a cylinder barrel, a piston that can slide back and forth in the cylinder barrel, and a transmission bar connected with the piston; the cylinder barrel comprises an air cavity and a mounting cavity, the cylinder barrel is provided with an air cavity vent in communication with the air cavity; the piston is slidably mounted within the mounting cavity, a restoring member for driving the piston and/or the transmission bar to restore to their initial positions is also mounted in the cylinder barrel; the piston is also provided with a sealing ring that can seal the air cavity.

In one of the optional technical solutions, the pushing force converting mechanism comprises two pushing force converting devices spaced apart.

In one of the optional technical solutions, the pushing force converting mechanism comprises a mounting bracket for connecting with the body of the water tank. The cylinder barrel is mounted on the mounting bracket.

In one of the optional technical solutions, the mounting bracket has a snap for clamping with the fixed support of the body of the water tank.

In one of the optional technical solutions, the restoring member is mounted within the air cavity and connected with the piston.

In one of the optional technical solutions, the sealing ring is fixedly mounted on the piston and can move along with the piston; when the piston is at an initial position, a vent gap is formed between the sealing ring and an opening of the air cavity.

In one of the optional technical solutions, the sealing ring is fixedly connected between the air cavity and the piston. The sealing ring has a sealing ring vent hole.

In one of the optional technical solutions, the sealing ring is a packing cup.

The technical solutions of the present disclosure also provide a concealed water tank comprising a body of the water tank and a pneumatic discharge valve having an air bag; wherein the body of the water tank is detachably provided with a pushing force converting mechanism according to any of the preceding technical solutions; the air bag is connected to the air cavity vent through an air pipe.

In one of the optional technical solutions, the body of the water tank has a mounting groove at one of its sides. A fixed support is mounted in the mounting groove. The mounting bracket of the pushing force converting mechanism is detachably connected with the fixed support.

By adopting the above technical solutions, the following technical effects are achieved.

Through the pushing force converting mechanism and the concealed water tank provided by the present disclosure, when a user presses down the panel button on the flushing panel, the transmission bar is pushed to move toward the air cavity. The transmission bar drives the piston to move, and thus the sealing ring seals the air cavity. With the movement of the piston, the sealing ring deforms toward the inside of the air cavity and squeezes the air cavity, such that the air within the air cavity is discharged via the air cavity vent. The discharged air can via the air pipe enter the air bag of the pneumatic discharge valve, which opens the pneumatic discharge valve to discharge water. When the panel button is released, under the action of the restoring member, the piston and the transmission bar are restored to their initial positions, and the sealing ring is thereby driven to restore to its initial position at the same time.

The pushing force converting mechanism and the concealed water tank provided by the present disclosure does not adopt a flexible structure such as an air bag. Instead, a rigid structure comprising a piston, a cylinder barrel, a transmission bar and a sealing ring is adopted, which can convert mechanical pushing force into air pressure pushing force and improve the stability of the structure.

In the pushing force converting mechanism and the concealed water tank provided by the present disclosure, the mechanical transmission efficiency of the transmission bar is high and the piston can be directly driven to move by the transmission bar.

In the pushing force converting mechanism and the concealed water tank provided by the present disclosure, its transmission bar can be triggered by various of panel buttons, and thus may match up with flushing panels of various types.

If the water tank has a pneumatic discharge valve, after the pushing force converting mechanism is taken away from the body of the water tank, an existing pneumatic driving device can be directly mounted on the body of the water tank. Therefore, interchange between the pushing force converting mechanism and an existing pneumatic driving device can be achieved, and more ways of assembling a concealed water tank with a flushing panel can be obtained.

DETAILED DESCRIPTION

Figure 1:
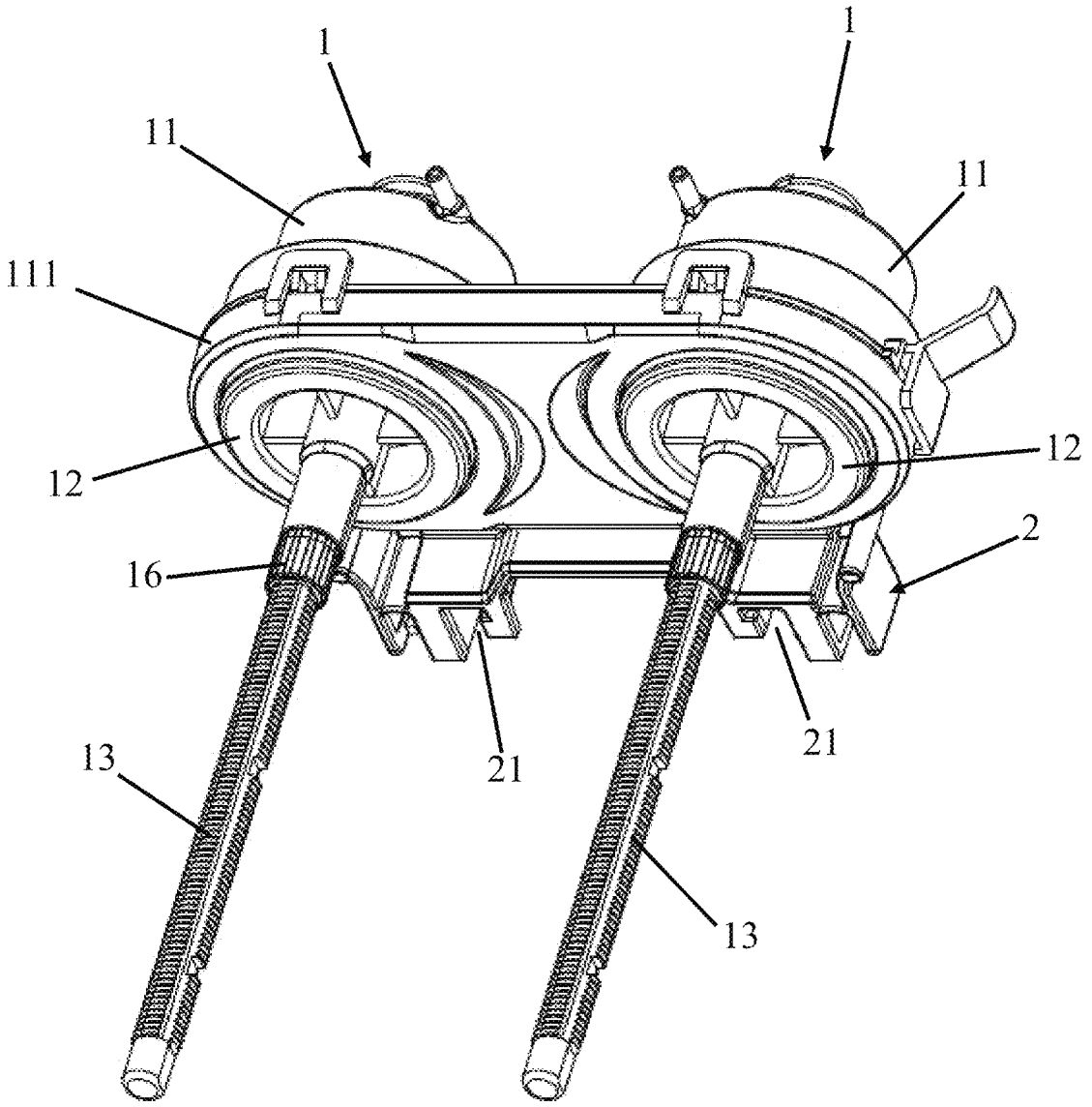
FIG. 1 is a perspective view of a pushing force converting mechanism provided by an embodiment of the present disclosure.

Hereinafter, the detailed embodiments of the present disclosure are described by reference to the accompanying drawings. Like reference numerals refer to like elements. It should be noted that, the terms of "front", "back", "left", "right", "up", and "down" used in the following description refer to the directions in the drawings; and the terms of "inner" and "outer" refer to the directions toward or away from the geometric center of a specific component, respectively.

Pushing Force Converting Mechanism

Figure 2:
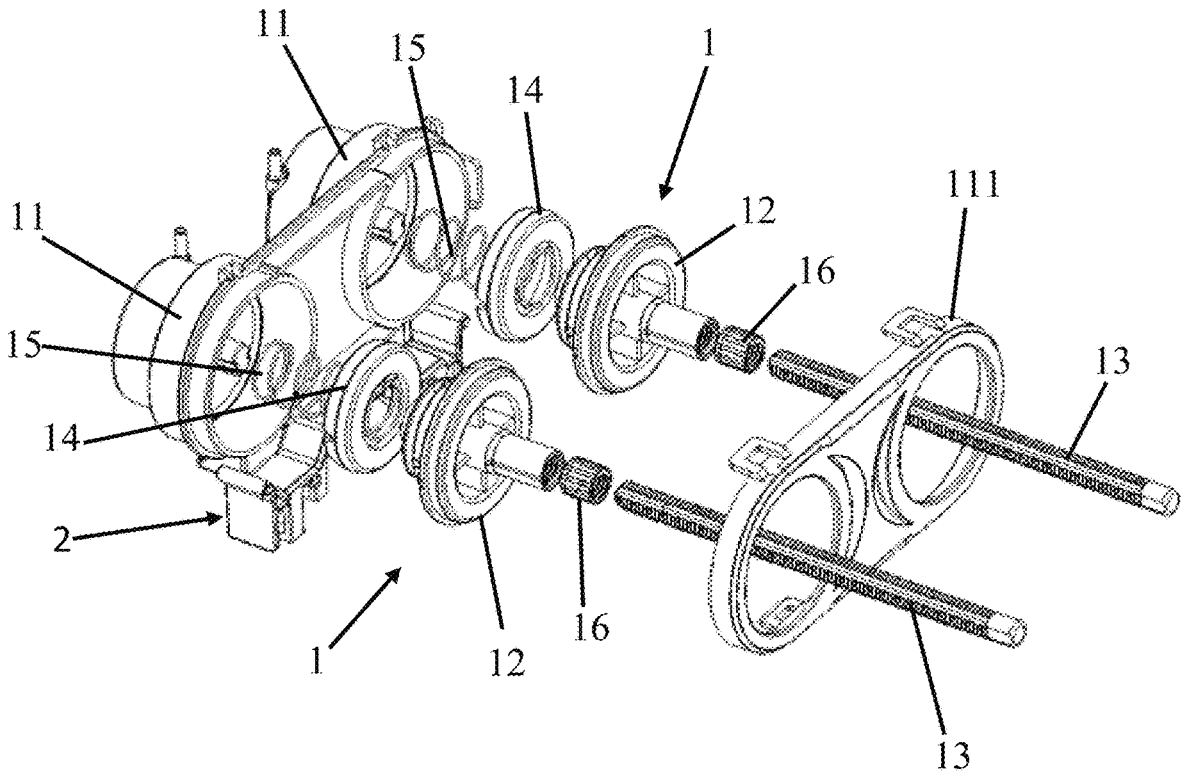
FIG. 2 is an exploded view of the pushing force converting mechanism as shown in FIG. 1.
Figure 3:
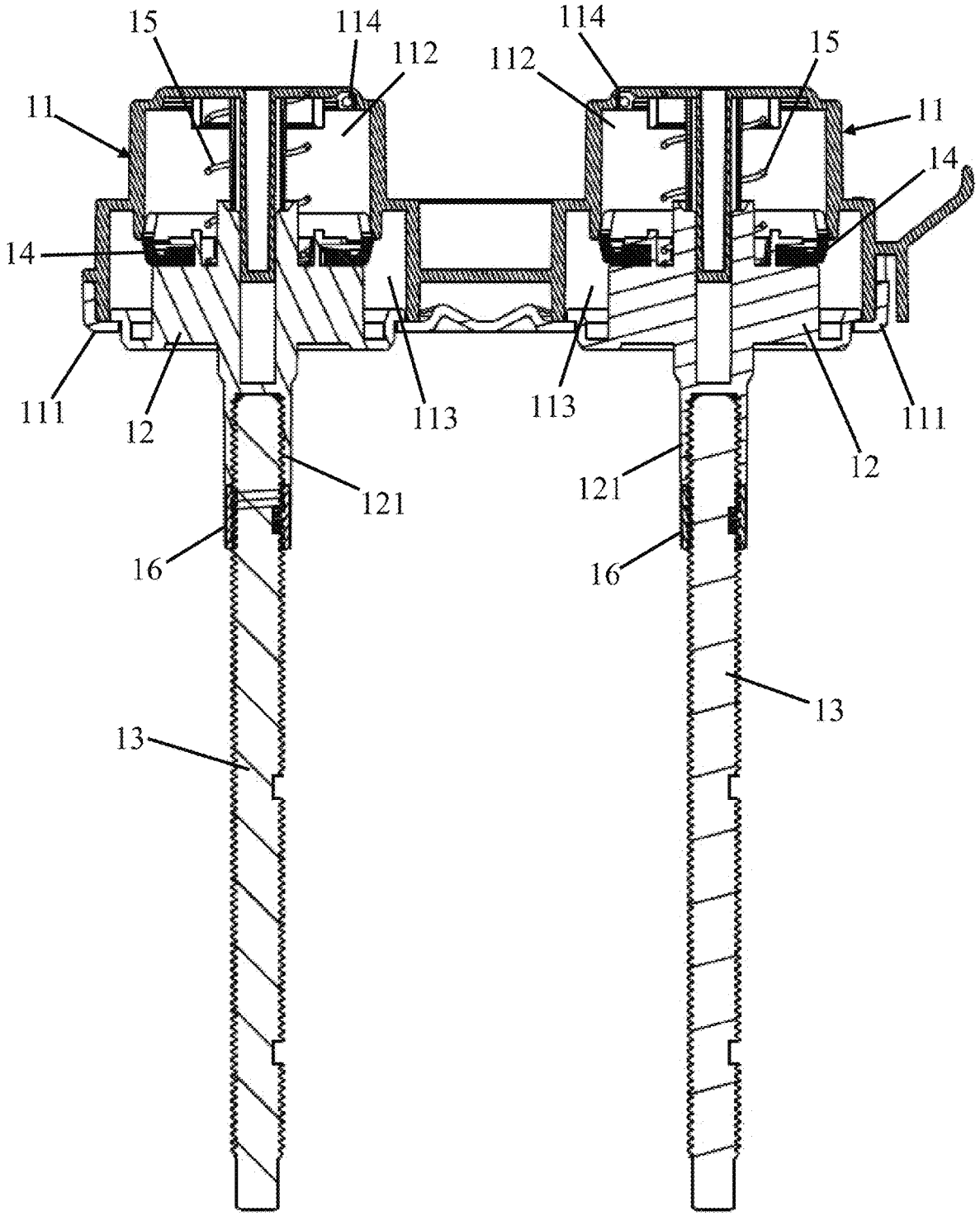
FIG. 3 is a sectional view of the pushing force converting mechanism as shown in FIG. 1.

As shown in FIG. 1 to FIG. 3, a pushing force converting mechanism provided by an embodiment of the present disclosure comprises at least one pushing force converting device 1.

The pushing force converting device 1 comprises a cylinder barrel 11, a piston 12 that is slidable back and forth in the cylinder barrel 11, and a transmission bar 13 connected with the piston 12.

The cylinder barrel 11 comprises an air cavity 112 and a mounting cavity 113. The cylinder barrel 11 is provided with an air cavity vent 114 in communication with the air cavity 112.

The piston 12 is slidably mounted within the mounting cavity 113. A restoring member 15 for driving the piston 12 and/or the transmission bar 13 to restore to their initial positions is also mounted within the cylinder barrel 11.

The piston 12 is also provided with a sealing ring 14 which can seal the air cavity 112.

Figure 6:
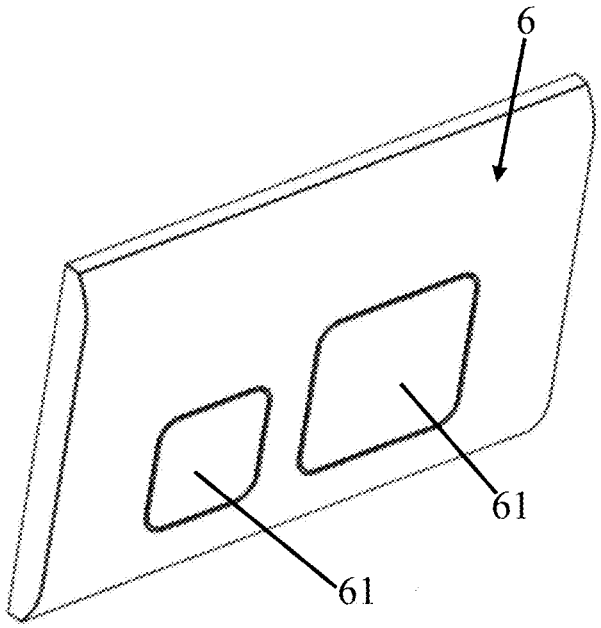
FIG. 6 is a perspective view of a type of flushing panel.

The pushing force converting mechanism provided by the present disclosure is used for transmitting motion between a concealed water tank and a flushing panel 6 as shown in FIG. 6.

The pushing force converting mechanism comprises one or more pushing force converting devices 1. Each pushing force converting device 1 comprises a cylinder barrel 11, a piston 12, a transmission bar 13, a sealing ring 14 and a restoring member 15.

Figure 4:
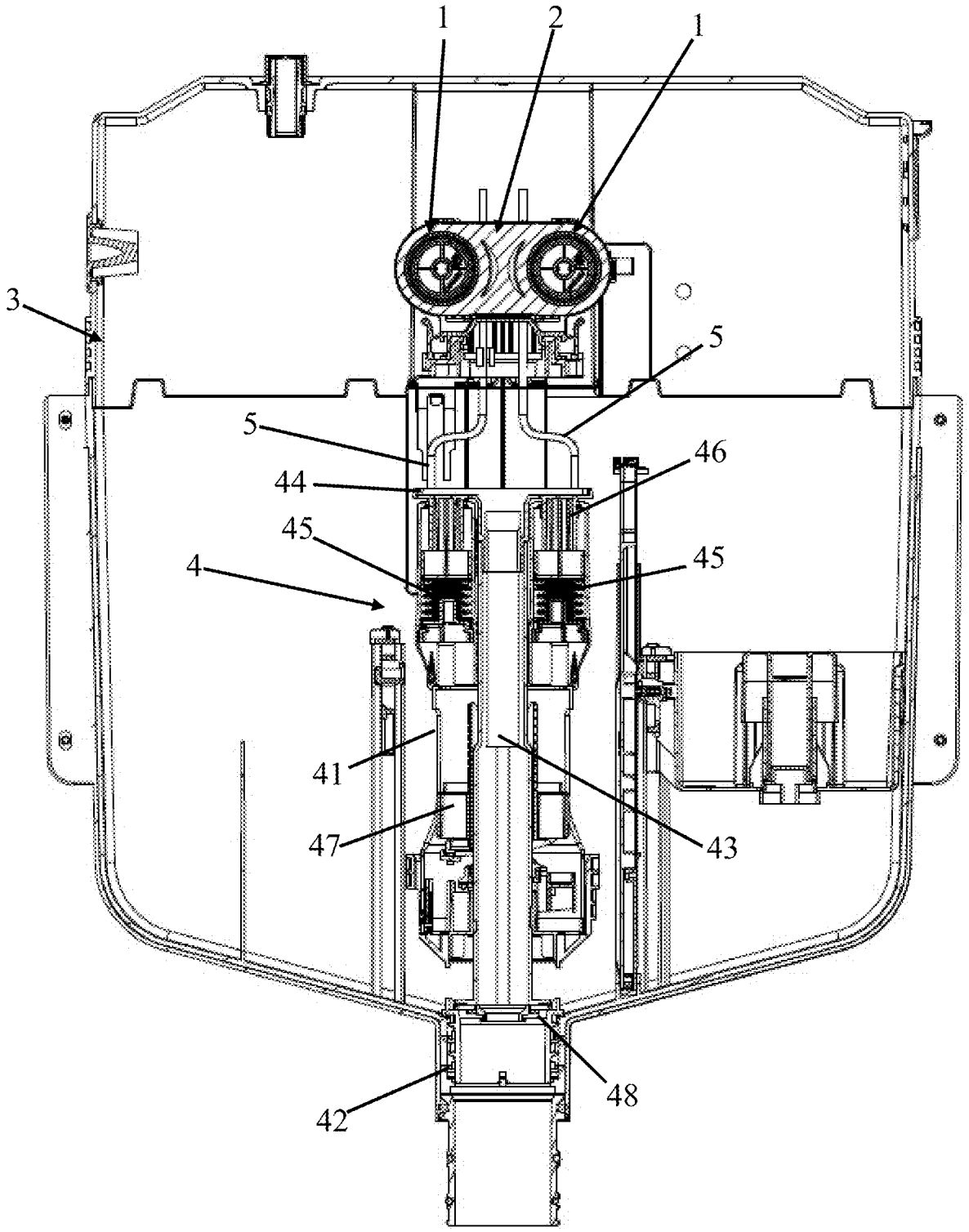
FIG. 4 is a schematic view of the internal structure of a concealed water tank provided by an embodiment of the present disclosure.
Figure 5:
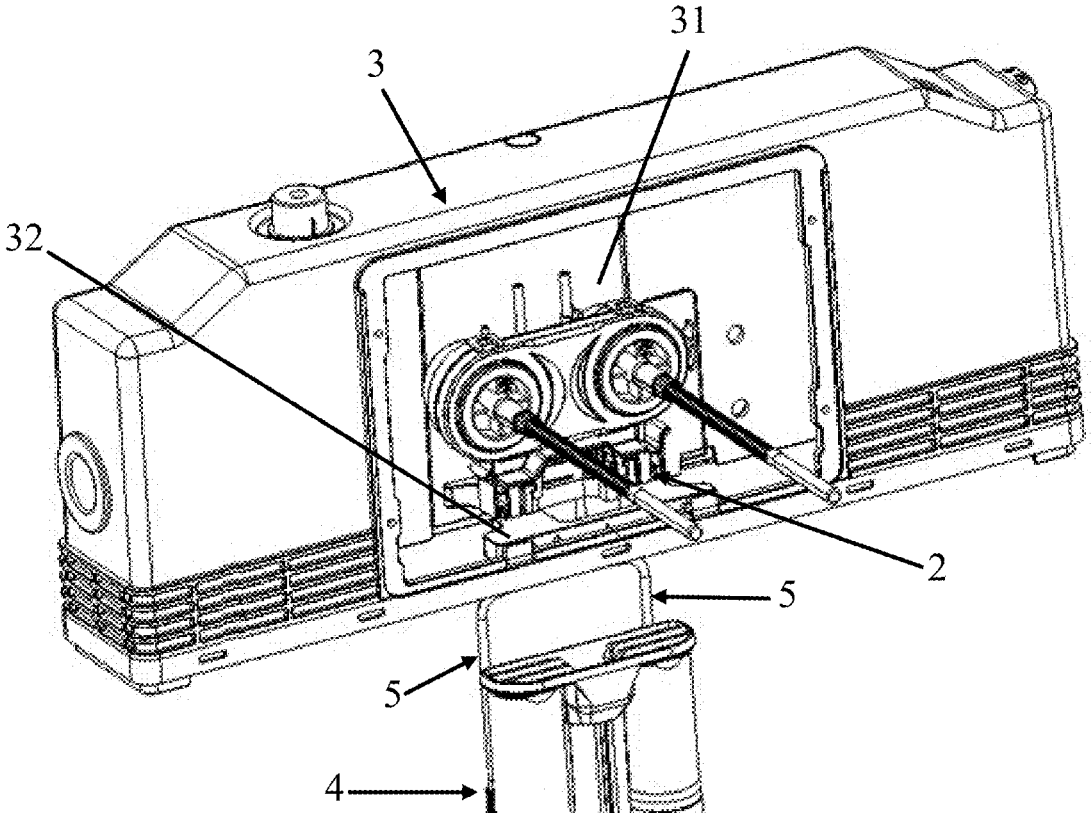
FIG. 5 is a schematic view which shows that a pushing force converting mechanism is mounted on the body of a water tank.

The cylinder barrel 11 has an end cap 111 on its front end. A mounting cavity 113 and an air cavity 112 are arranged from front to rear in the cylinder barrel 11. The cylinder barrel 11 also has an air cavity vent 114 in communication with the air cavity 112. The air cavity vent 114 is connected to or in communication with an air bag 45 in a pneumatic discharge valve 4 through an air pipe 5 as shown in FIGS. 4 and 5.

The piston 12 is slidably assembled within the mounting cavity 113, and the end cap 111 is used for limiting the position of the piston 12. The piston 12 can move back and forth within the mounting cavity 113. The transmission bar 13 is connected to the piston 12, for driving the piston 12 to move toward the air cavity 112.

The sealing ring 14 is mounted on the piston 12 and can seal the opening of the air cavity 112. Thus, when the piston 12 moves toward the air cavity 112, the sealing ring 14 deforms toward an inside or an internal space of the air cavity 112 to squeeze the air within the air cavity 112. The air within the air cavity 112 is discharged via the air cavity vent 114.

The restoring member 15 is mounted in the cylinder barrel 11 and can act on the piston 12, or on the transmission bar 13, or on both the piston 12 and the transmission bar 13. The restoring member 15 is used for driving the piston 12 and/or the transmission bar 13 to move toward the end cap 111 to restore to their initial positions.

During installation, the concealed water tank is mounted in a wall; the flushing panel 6 is mounted on a surface of the wall; the cylinder barrel of the pushing force converting mechanism is mounted on the body of the water tank, with the transmission bar 13 being toward the flushing panel 6. The flushing panel 6 has panel buttons 61 triggered by press, which can push the transmission bars 13 to move.

By reference to FIGS. 1-6, when discharging of water is needed, a user presses down the panel button 61, which in turn pushes the transmission bar 13 to move. The transmission bar 13 drives the piston 12 to move toward the air cavity 112, which in turn drives the sealing ring 14 to squeeze the air within the air cavity 112, and the air within the air cavity 112 enters the air bag 45 in the pneumatic discharge valve 4 via the air cavity vent 114 and the air pipe 5. The air bag 45 increases in volume and drives a pushing cylinder 46 to rise up and lift an extension plate 44 on the upper end of the overflow pipe 43, which thereby drives the overflow pipe 43 to rise up in the valve body 41. Accordingly, the water baffle ring 48 at the lower end of the overflow pipes 43 leaves the valve base 42 to enable discharging of water.

After the user releases the panel button 61, the piston 12, the transmission bar 13 and the sealing ring 14 restore to their initial positions under the action of the restoring member 15.

When the water level in the body 3 of the water tank is lower than the floater 47, under the influence of gravity, the overflow pipe 43 falls down, the extension plate 44 squeezes the air bag 45 via the pushing cylinder 46, and the air within the air bag 45 can be discharged via a one-directional vent provided on the air bag, or can be returned to the air cavity 112 through the air pipe 5.

The sealing ring 14 may be mounted in two ways, listed as below:

The first way of mounting includes having the sealing ring 14 move along with the piston 12 and seal the air cavity 112 as the piston 12 moves. After restoring to its initial position, the sealing ring 14 separates from the air cavity 112, or a gap exists between them and the air cavity 112 can exchange air with the external environment via the gap.

The second way of mounting includes having the edge of one side of the sealing ring 14 is fixedly connected with the piston 12, the edge of the other side is hermetically connected with the opening of the cavity 112, and the sealing ring 14 has a sealing ring vent. The air cavity 112 can exchange air with external environment via the sealing ring vent.

The pushing force converting mechanism provided by the present disclosure adopts a rigid mechanical structure comprised by a cylinder barrel 11, a piston 12, a transmission bar 13 and a sealing ring 14, which can convert mechanical pushing force into air pressure pushing force and can improve the structure stability.

In the pushing force converting mechanism provided by the present disclosure, the transmission bar 13 has high mechanical transmission efficiency. Under the action of the panel buttons 61, the transmission bar 13 can directly drive the piston 12 to move toward the air cavity 112. When the transmission bar 13 and the piston 12 are returned to their initial positions, the sealing ring 14 can be driven to quickly restore to its initial state.

The transmission bar 13 of the pushing force converting mechanism provided by the present disclosure can be triggered by various of panel buttons, and thus may match up with flushing panels 6 of various types.

In one of the embodiments, the restoring member 15 is a spring, an elastic sheet, or the like.

In one of the embodiments, as shown in FIG. 3, the transmission bar 13 is a screw bar. A sleeve 121 having internal threads is integrally formed with the piston 12. One end of the screw bar is in thread connection with the sleeve 121 and is locked by a nut 16.

In one of the embodiments, as shown in FIGS. 1-3, the pushing force converting mechanism comprises two pushing force converting devices 1 spaced apart, so as to match up with a pneumatic discharge valve having two air bags 45.

In one of the embodiments, as shown in FIGS. 1, 2, and 5, the pushing force converting mechanism comprises a mounting bracket 2 for connecting with the body 3 of the water tank. The cylinder barrel 11 is mounted on the mounting bracket 2. The mounting bracket 2 is used for mounting on the body 3 of the water tank to provide fixed support for the cylinder barrel 11, so as to facilitate assembling the pushing force converting mechanism on the body 3 of the water tank.

In one of the embodiments, as shown in FIG. 1, the mounting bracket 2 has a snap 21 for clamping with a fixed support 32 of the body 3 of the water tank. The body 3 of the water tank has a mounting groove 31 at its side facing the flushing panel 6. The fixed support 32 is fixedly mounted at the bottom of the mounting groove 31. The fixed support 32 has claws. The snaps 21 on the mounting bracket 2 are engaged with the claws, which facilitates mounting and replacement.

In one of the embodiments, as shown in FIG. 3, the restoring member 15 is mounted within the air cavity 112 and is connected to the piston 12.

In this embodiment, the restoring member 15 is mounted in the air cavity 112 and directly acts on the piston 12, which facilitates to actuate the piston 12 to drive the transmission bar 13 and the sealing ring 14 to restore to their initial positions.

In one of the embodiments, the sealing ring 14 is fixedly mounted on the piston 12 and can move along with the piston 12.

When the piston 12 is at its initial position, a vent gap is formed between the sealing ring 14 and the opening of the air cavity 112.

In this embodiment, the first way of mounting is selected for the sealing ring 14. When the piston 12 is at its initial state, the sealing ring 14 is at least partly separated from the opening of the air cavity 12, such that a vent gap is formed between the sealing ring 14 and the opening of the air cavity 112. External air can enter the air cavity 112 via the vent gap. After the transmission bar 13 is driven to move toward the air cavity 112, the sealing ring 14 can seal the opening of the air cavity 112 and deform toward the inside of the air cavity 112, such that the air within the air cavity 112 is squeezed and discharged via the air cavity vent 114. After the piston 12 restores to its initial position, the air entering the air cavity 112 via the air pipe 5 may be discharged via the vent gap.

In one of the embodiments, the sealing ring 14 is fixedly connected between the air cavity 112 and the piston 12. The sealing ring 14 has a sealing ring vent hole.

In this embodiment, the second way of mounting is selected for the sealing ring 14. When the piston 12 is at its initial state, external air can enter the air cavity 112 via the sealing ring vent hole. When moving toward the air cavity 112, the piston 12 can drive the sealing ring 14 to deform toward the inside of the air cavity 112. The air within the air cavity 112 is squeezed and discharged via the air cavity vent 114. After the piston 12 restores to its initial position, the air entering the air cavity 112 through the air pipe 5 can be discharged via the sealing ring vent hole.

According to requirements, the size of the opening of the air cavity 112 may be greater than the size of the piston 12. The piston 12 can thus move into the air cavity 112 to increase the capability of squeezing the air cavity 112 and increase the air pressure in the air cavity 112, such that the air can be discharged quickly via the air cavity vent 114.

In one of the embodiments, the sealing ring is a packing cup having concave-convex structure, which has large deformation amplitude and can increase the capability of squeezing the air cavity 112, and thus the air pressure in the air cavity 112 can be increased.

Water Tank

As shown in FIGS. 4 and 5, a concealed water tank provided by one embodiment of the present disclosure comprises a body 3 of the water tank and a pneumatic discharge valve 4 having air bags 45.

The pushing force converting mechanism described in any one of the preceding embodiments is detachably provided on the body 3 of the water tank.

The air bags 45 are connected to the air cavity vents 114 through the air pipes 5.

Regarding the structure, construction and operating principle of the pushing force converting mechanism, reference can be made to the preceding description about the pushing force converting mechanism, which is not repeated herein for sake of brevity.

The air pipe 5 is a flexible hose, which facilitates arrangement.

The pneumatic discharge valve 4 is mounted within the body 3 of the water tank for controlling the discharging of the water tank. The pneumatic discharge valve 4 comprises a valve body 41, a valve seat 42 having a water outlet, an overflow pipe 43 that can move up and down in the valve body 41, an extension plate 44 provided on the top of the overflow pipe 43, air bags 45 provided in the valve body 41, pushing cylinders 46 between the air bags 45 and the extension plate 44, floaters 47 provided at the lower portion of the overflow pipe 43, and a water baffle ring 48 provided at the lower end of the overflow pipe 43.

When discharging of water is needed, a user presses down a panel button 61, which in turn pushes the transmission bar 13 to move. The transmission bar 13 drives the piston 12 to move toward the air cavity 112 and in turn drives the sealing ring 14 to squeeze the air within the air cavity 112. The air within the air cavity 112 enters an air bag 45 in the pneumatic discharge valve 4 through the air cavity vent 114 and the air pipe 5. The air bag 45 increases in volume and drives the pushing cylinder 46 to rise up and lift the extension plate 44 on the upper end of the overflow pipe 43, which thereby drives the overflow pipe 43 to rise up in the valve body 41. Accordingly, the water baffle ring 48 at the lower end of the overflow pipe 43 leaves the valve seat 42 to enable discharging of water.

After the user releases the panel button 61, the piston 12, the transmission bar 13 and the sealing ring 14 restore to their initial positions under the action of the restoring member 15.

When the water level in the body 3 of the water tank is lower than the floater 47, under the influence of gravity, the overflow pipe 43 falls down, the extension plate 44 squeezes the air bag 45 through the pushing cylinder 46, and the air within the air bag 45 can be discharged via a one-directional vent provided on the air bag 45, or it can be returned to the air cavity 112 through the air pipe 5.

After the pushing force converting mechanism is taken away from the body 3 of the water tank, an existing pneumatic driving device can be directly mounted on the body 3 of the water tank. Therefore, interchange between the pushing force converting mechanism and an existing pneumatic driving device driven can be achieved, and more ways of assembling a concealed water tank with a flushing panel 6 can be obtained.

In one of the embodiments, as shown in FIG. 5, the body 3 of the water tank has a mounting groove 31 at one of its sides. A fixed support 32 is mounted in the mounting groove 31. The mounting bracket 2 of the pushing force converting mechanism is detachably connected with the fixed support 32.

The fixed support 32 is fixedly mounted at the bottom of the mounting groove 31. Claws are provided on the fixed support 32. Each snap 21 on the mounting bracket 2 is engaged with respective claw, which facilitates mounting and replacement.

Methods for Operating Water Tank

Figure 7:
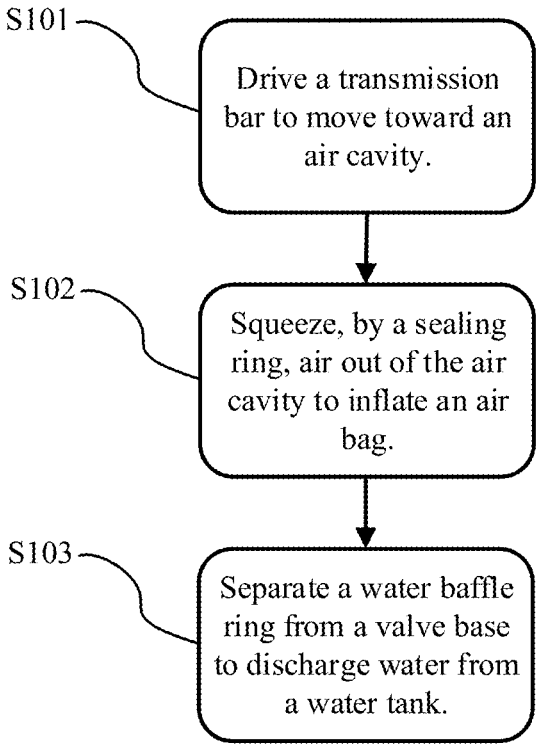
FIG. 7 illustrates a method for operating the water tank to discharge the water from the water tank according to one embodiment of the present disclosure.

FIG. 7 illustrates a method for operating the water tank to discharge the water from the water tank according to one embodiment of the present disclosure.

At act S101, a toilet user may drive the transmission bar 13 to move toward the air cavity 112 by pressing the panel button 61. As discussed above, the transmission bar 13 is connected with the piston 12. Thus, the piston 12 moves, along with the transmission bar 13, toward the air cavity 112.

At act S102, the sealing ring 14 squeeze the air out of the air cavity 112 to inflate the air bag 45. Specifically, when the piston 12 moves toward the air cavity 112, the sealing ring 14 deforms toward the internal space of the air cavity 112. Thus, the air in the air cavity 112 is discharged from the air cavity 112 via the air cavity vent 114 and the air pipe 5 and enters the air bag 45.

At act S103, the water baffle ring 48 is separated from the valve base 42 to discharge the water from the water tank. Specifically, when the air bag 45 is inflated, the increased volume of the air bag 45 drives the pushing cylinder 46 to lift the extension plate 44 provided at the upper end of the overflow pipe 43. Thus, the overflow pipe 43 moves up in the valve body 41 to raise the water baffle ring 48 provided at the lower end of the overflow pipe 43. Therefore, the space between the water baffle ring 48 and the valve base 42 allows the water in the water tank to flow into a toilet bowl.

Figure 8:
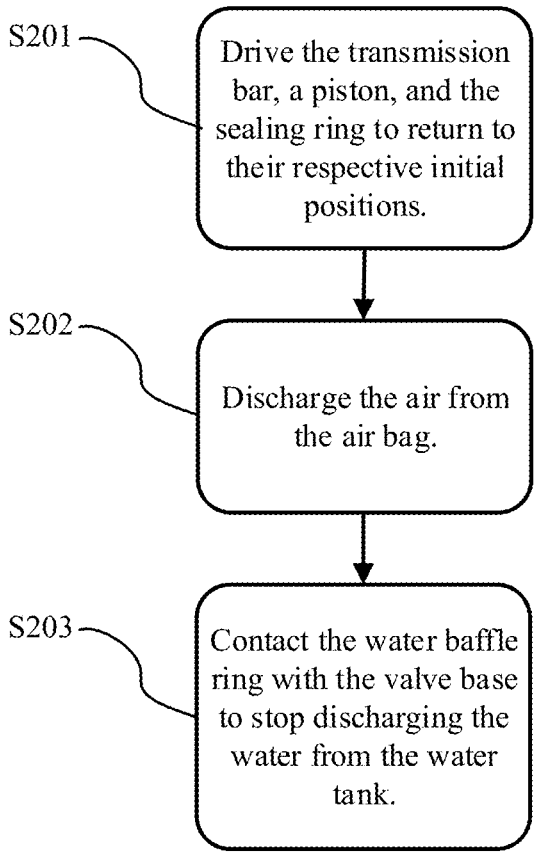
FIG. 8 illustrates a method for operating the water tank to stop discharging the water from the water tank according to one embodiment of the present disclosure.

FIG. 8 illustrates a method for operating the water tank to stop discharging the water from the water tank according to one embodiment of the present disclosure.

At act S201, the toilet user may drive the transmission bar 13, the piston 12, and the sealing ring 14 to return to their respective initial positions by releasing the panel button 61. Specifically, the restoring member 15 may act on the piston 12 and/or the transmission bar 13 to drive the piston 12 and/or the transmission bar 13 to move toward the end cap 111.

At act S202, the air is discharged from the air bag 45. Specifically, when the water level in the body 3 of the water tank is lower than the floater 47, the overflow pipe 43 moves down in the valve body 41 under the influence of the gravity. The extension plate 44 squeezes the air bag 45 via the pushing cylinder 46. Thus, the air in the air bag 45 may be discharged from the one-directional vent of the air bag 45. In another embodiment, the air in the air bag 45 may be returned to the air cavity 112 through the air pipe 5 and the air cavity vent 114 and then discharged from the sealing ring vent hole.

At act S203, the water baffle ring 48 contacts the valve base 42 to stop discharging the water from the water tank. Specifically, when the air is discharged from the air bag 45, the volume of the air bag 45 is decreased and thus the water baffle ring 48 moves down to contact the valve base 42 under the influence of the gravity. Therefore, the space between the water baffle ring 48 and the valve base 42 is closed to stop discharging the water into the toilet bowl.

Method for Assembling Water Tank

Figure 9:
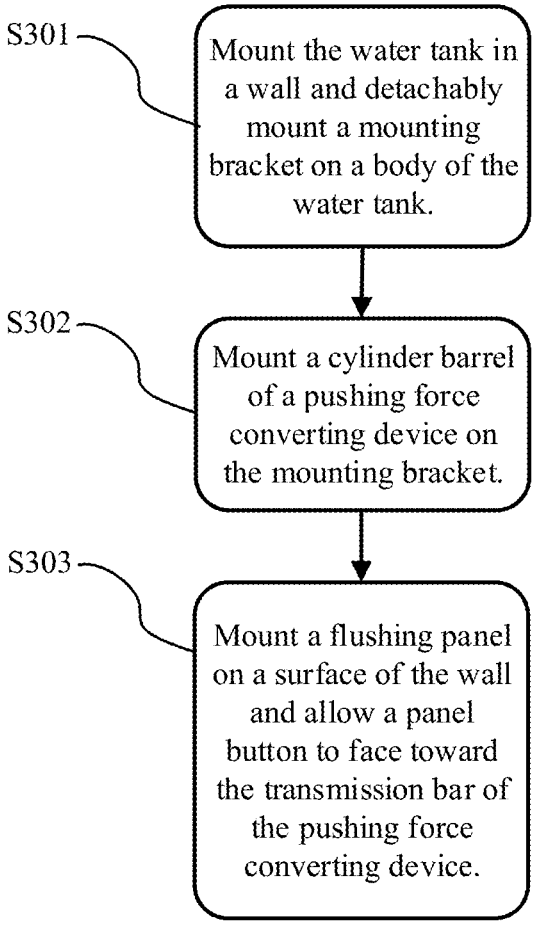
FIG. 9 illustrates a method for assembling the water tank according to one embodiment of the present disclosure.

FIG. 9 illustrates a method for assembly the water tank according to one embodiment of the present disclosure.

At act S301, the water tank is mounted in the wall and the mounting bracket 2 is detachably mounted on the body 3 of the water tank. Specifically, the fixed support 32 of the water tank is mounted on the mounting groove 31 of the water tank. The snap 21 of the mounting bracket is engaged with the claws of the fixed support 32 of the water tank. Thus, this configuration may facilitate the installation and the replacement of the pushing force converting device 1.

At act S302, the cylinder barrel 11 of the pushing force converting device 1 is mounted on the mounting bracket 2. Thus, the mounting bracket 2 may provide the support for the cylinder barrel 11.

At act S303, the flushing panel 6 is mounted on the surface of the wall and disposed in a position allowing the panel button 61 to face toward the transmission bar 13 of the pushing force converting device 1. Thus, the toilet user may use the panel button 61 of the flushing panel 6 to flush the water from the water tank to clean the toilet bowl.

In another embodiment, a different sequence of the above discussed acts may be used in the method. For example, act S302 may be performed before act S301.

According to requirements, the above technical solutions can be combined to achieve an optimum technical effect.

The above described are only the principle and embodiments of the present disclosure. It should be noted that, for those having ordinary skill in the art, several other variations may be made on the basis of the principle of the present disclosure. These variations should also be considered as falling into the protection scope of the present disclosure.

We claim:

1. A pushing force converting device, comprising:

a cylinder barrel, comprising:

an air cavity;

a mounting cavity; and an air cavity vent in communication with the air cavity;

a piston configured to slide back and forth in the cylinder barrel and slidably disposed in the mounting cavity;

a transmission bar connected with the piston and configured to drive the piston to move toward the air cavity;

a restoring member disposed in the cylinder barrel and configured to drive the piston or the transmission bar to be restored to a respective initial position; and a sealing ring disposed on the piston and configured to seal the air cavity, wherein the sealing ring comprises a sealing ring vent hole, and wherein when the piston or the transmission bar is restored to the respective initial position, air entering the air cavity via an air pipe is discharged via the sealing ring vent hole.

2. The pushing force converting device according to claim 1, wherein the restoring member is disposed in the air cavity and the restoring member is connected to the piston.

3. The pushing force converting device according to claim 1, wherein when the piston moves toward an opening of the air cavity, the sealing ring deforms toward an internal space of the air cavity to squeeze air in the air cavity and the air in the air cavity is discharged from the air cavity via the air cavity vent.

4. The pushing force converting device according to claim 3, wherein the sealing ring is fixedly mounted on the piston and configured to move with the piston; and wherein when the piston is disposed at the respective initial position, a vent gap is formed between the sealing ring and the opening of the air cavity.

5. The pushing force converting device according to claim 4, wherein the air cavity vent is in communication with an air bag in a pneumatic discharge valve through an air pipe;

wherein the air discharged from the air cavity enters the air bag in the pneumatic discharge valve via the air cavity vent and the air pipe; and wherein when the piston is restored to the respective initial position, the air entering the air cavity via the air pipe is discharged via the vent gap.

6. The pushing force converting device according to claim 3, wherein the sealing ring is fixedly disposed between the air cavity and the piston.

7. The pushing force converting device according to claim 6, wherein the air cavity vent is in communication with an air bag in a pneumatic discharge valve through the air pipe; and wherein the air discharged from the air cavity enters the air bag in the pneumatic discharge valve via the air cavity vent and the air pipe.

8. The pushing force converting device according to claim 1, further comprising an end cap configured to limit a position of the piston, wherein the restoring member is configured to drive the piston or the transmission bar to move toward the end cap to restore the piston or the transmission bar to the respective initial position.

9. The pushing force converting device according to claim 1, wherein the sealing ring is a packing cup.

10. A pushing force converting mechanism, comprising at least one pushing force converting device, wherein the at least one pushing force converting device comprises:

a cylinder barrel, comprising:

an air cavity;

a mounting cavity; and an air cavity vent in communication with the air cavity;

a piston configured to slide back and forth in the cylinder barrel and slidably disposed in the mounting cavity;

a transmission bar connected with the piston and configured to drive the piston to move toward the air cavity;

a restoring member disposed in the cylinder barrel and configured to drive the piston or the transmission bar to be restored to a respective initial position; and a sealing ring disposed on the piston and configured to seal the air cavity, wherein the sealing ring comprises a sealing ring vent hole, and wherein when the piston or the transmission bar is restored to the respective initial position, air entering the air cavity via an air pipe is discharged via the sealing ring vent hole.

11. The pushing force converting mechanism according to claim 10, wherein the pushing force converting mechanism comprises two pushing force converting devices spaced apart from each other.

12. The pushing force converting mechanism according to claim 10, further comprising a mounting bracket configured to be connected with a body of a water tank, wherein the cylinder barrel is mounted on the mounting bracket.

13. The pushing force converting mechanism according to claim 12, wherein the mounting bracket comprises a snap configured to be clamped with a fixed support of the body of the water tank.

14. A water tank, comprising:

a body detachably connected with a pushing force converting mechanism; and a pneumatic discharge valve comprising an air bag, wherein the pushing force converting mechanism comprises:

a cylinder barrel, comprising:

an air cavity;

a mounting cavity; and an air cavity vent in communication with the air bag through an air pipe and in communication with the air cavity;

a piston configured to slide back and forth in the cylinder barrel and slidably disposed in the mounting cavity;

a transmission bar connected with the piston and configured to drive the piston to move toward the air cavity;

a restoring member disposed in the cylinder barrel and configured to drive the piston or the transmission bar to be restored to a respective initial position; and a sealing ring disposed on the piston and configured to seal the air cavity, wherein the sealing ring comprises a sealing ring vent hole; and wherein when the piston or the transmission bar is restored to the respective initial position, air entering the air cavity via the air pipe is discharged via the sealing ring vent hole.

15. The water tank according to claim 14, wherein the body of the water tank comprises a mounting groove on one side of the body of the water tank;

wherein a fixed support is mounted in the mounting groove; and wherein a mounting bracket of the pushing force converting mechanism is detachably connected with the fixed support.

16. The water tank according to claim 14, further comprising a flushing panel configured to push the piston to move toward an opening of the air cavity when a user press the flushing panel, wherein when the piston moves toward the opening of the air cavity, the sealing ring deforms toward an internal space of the air cavity to squeeze air in the air cavity and the air in the air cavity is discharged from the air cavity via the air cavity vent.

17. The water tank according to claim 16, wherein when the piston moves toward the opening of the air cavity, the air discharged from the air cavity enters the air bag in the pneumatic discharge valve via the air cavity vent and the air pipe to increase a volume of the air bag; and wherein the air bag with the increased volume lifts up a water baffle ring of the pneumatic discharge valve to leave from a valve base of the pneumatic discharge valve so as to discharge water from the body of the water tank.

18. The water tank according to claim 17, wherein the flushing panel is further configured to restore to the piston to the respective initial position under an action of the restoring member when the user releases the flushing panel; and wherein when the piston is restored to the respective initial position, the air in the air cavity enters the air cavity via the air pipe.

19. The water tank according to claim 18, wherein when the piston is disposed at the respective initial position, a vent gap is formed between the sealing ring and the opening of the air cavity; and wherein when the piston is restored to the respective initial position, the air entering the air cavity via the air pipe is discharged via the vent gap.

* * * * *